US005785117A

United States Patent [19]

Grinbergs

[11] Patent Number: 5,785,117

[45] Date of Patent: Jul. 28, 1998

[54] AIR-TO-AIR HEAT EXCHANGER CORE

[75] Inventor: Peter Karl Grinbergs, Dorchester, Canada

[73] Assignee: Nutech Energy Systems Inc., London, Canada

[21] Appl. No.: 798,341

[22] Filed: Feb. 10, 1997

[51] Int. Cl.[6] ..... F28F 3/00

[52] U.S. Cl. ..... 165/166; 165/165; 165/DIG. 373; 165/DIG. 382

[58] Field of Search ..... 165/166, 165, 165/164, 167, DIG. 373, DIG. 382

[56] References Cited

U.S. PATENT DOCUMENTS

| | | | |
|---|---|---|---|
| Re. 16,807 | 12/1927 | Haber | 165/166 X |
| 1,635,838 | 7/1927 | Haber | 165/166 |
| 1,727,124 | 9/1929 | Lonsdale | 165/166 |
| 2,368,814 | 2/1945 | Fagan | 165/166 |
| 2,959,401 | 11/1960 | Burton | 165/166 |
| 3,893,509 | 7/1975 | Satchwell et al. | 165/DIG. 382 X |
| 4,125,153 | 11/1978 | Stoneberg | 165/166 |
| 4,343,355 | 8/1982 | Goloff et al. | 165/166 |
| 4,350,201 | 9/1982 | Steineman | 165/166 X |
| 4,554,719 | 11/1985 | Lewis | 29/157.3 R |
| 4,681,155 | 7/1987 | Kredo | 165/166 X |
| 4,848,450 | 7/1989 | Lapkowsky | 165/166 |
| 5,072,790 | 12/1991 | Lapowsky | 165/166 |
| 5,322,117 | 6/1994 | Guetersloh et al. | 165/166 |

*Primary Examiner*—Ira S. Lazarus
*Assistant Examiner*—Christopher Atkinson

[57] ABSTRACT

The present invention relates to a core assembly for use in an air-to-air heat exchanger. The core is comprised of a plurality of square plates. Each plate is comprised of a square planar central region; a first pair of opposed edge flanges bent in a first direction with respect to the central region to form approximately 90 degree angle with the central region; and a second pair of opposed edge flanges bent in a direction opposite the first direction with respect to the central region to form approximately 90 degree angle with the central region. The core is formed by the plurality of square plates that are positioned into a stack of parallel plates such that the opposed flanges of one of the plurality of plates is located in contact with and inside mating opposed flanges of a plate directly adjacent thereto, thereby forming a plurality of air passages between adjacent plates such that two perpendicular air pathways are formed in an interleaved orientation. A frame is provided in contact with a bottom plate in the stack and a top plate in the stack for holding the plurality of plates in position.

6 Claims, 2 Drawing Sheets

AIR-TO-AIR HEAT EXCHANGER CORE

The present invention relates to an improvement in the core of an air-to-air heat exchange unit. More particularly the present invention relates to the way the plates of the core that separate the two air flow paths are fabricated and assembled.

It is known to provide a series of parallel metal plates that form two air flow paths. The alternate edges of these parallel plates are formed into flanges that interconnect with mating flanges on directly adjacent plates to form alternating air passages for the two air flow paths. A portion of the heat energy of the air moving in one air flow path is transferred through the metal plates into the air flowing in the other air flow path. Such heat exchangers are commonly used in buildings where it is desired to add fresh outside air to the building and to exhaust stale inside air out of the building. Some of the heat energy of the warm stale air being exhausted from the building is recovered by transferring that heat energy to the colder incoming fresh air via a heat exchange core.

One such system is described in U.S. Pat. No. 4,554,719 which issued on Nov. 26, 1985. That patent describes a method of folding the metal on the upstanding alternate edges of each plate so that each plate is connected to an adjacent plate making up the core.

The present invention has realized, that at the operating pressures that are met with devices of this nature, a much more simple method can be used to interconnect the adjacent plates in such a manner that they are virtually air tight. The present invention makes it much more simple to interconnect the plates that make up the heat exchange core.

Each plate in the core is comprised of a generally square flat metal plate having four edge flanges. Edge flanges located along opposite edges are bent in one direction so that they are formed in a plane that is generally perpendicular to the flat surface of the plate. Edges of the flanges along the other opposite edges are bent in exactly the same manner but in the opposite direction. In other words, if the flat plate were oriented horizontally, the left and right side edge flanges are bent downwardly into a generally vertical plane and the front and rear side edge flanges are bent upwardly into a generally vertical plane.

In the preferred embodiment the side flanges are not bent into a flat plane but are slightly curved. The side flanges do not necessarily have to be curved. They could be triangularly shaped, wherein they are bent to slope outwardly initially away from the plate and then are bent to slope inwardly.

Each plate is made from a fairly thin material and is exactly of the same dimensions as every other plate. To assemble the core, two adjacent plates are interconnected so that the curved side edges engage. This provides one plate having opposite edge flanges that are located inside the opposite edge flanges of the adjacent plate. Since the plates are of the same dimensions, the inner curved edge flanges push outwardly against the outer curved edge flanges of the adjacent plate. An interference fit is achieved and because the material of each plate is relatively thin the outer curved edge flanges of one plate are flexed slightly outwardly and the inner edge flanges of the adjacent plate are flexed slightly inwardly. This flexing provides an airtight seal along the edge of two adjacent plates. In this way an air passage is formed between the two adjacent plates.

Because each plate is of the same dimension, when the core is being assembled, the inner plate at the top of the core bends upwardly in the middle until the next plate is installed. The next plate straightens the plate directly below because it becomes the plate having the inner opposite side flanges. In this manner each plate is straightened as the core is assembled. The very top plate in the assembled core will be bent slightly upwardly in the middle. However, the assembled core is placed in a support frame and the frame is made of a slightly thicker material making it more rigid. The frame therefore straightens the top plate of the core to make a uniform core assembly.

In accordance with one aspect of the present invention, there is provided a core assembly for use in an air-to-air heat exchanger, said core comprising: a plurality of square plates, each plate comprising: a square planar central region; a first pair of opposed edge flanges bent in a first direction with respect to said central region to form approximately a 90 degree angle with the central region; a second pair of opposed edge flanges bent in a direction opposite said first direction with respect to said central region to form approximately a 90 degree angle with the central region; wherein said core is formed by said plurality of square plates that are positioned into a stack of parallel plates such that the opposed flanges of one of said plurality of plates is located in contact with and inside mating opposed flanges of a plate directly adjacent thereto, thereby forming a plurality of air passages between adjacent plates such that two perpendicular air pathways are formed in an interleaved orientation; frame means in contact with a bottom plate in said stack and a top plate in said stack for holding said plurality of plates in position.

The present invention will be described below in detail with the aid of the accompanying drawings, in which.

Figure 1:
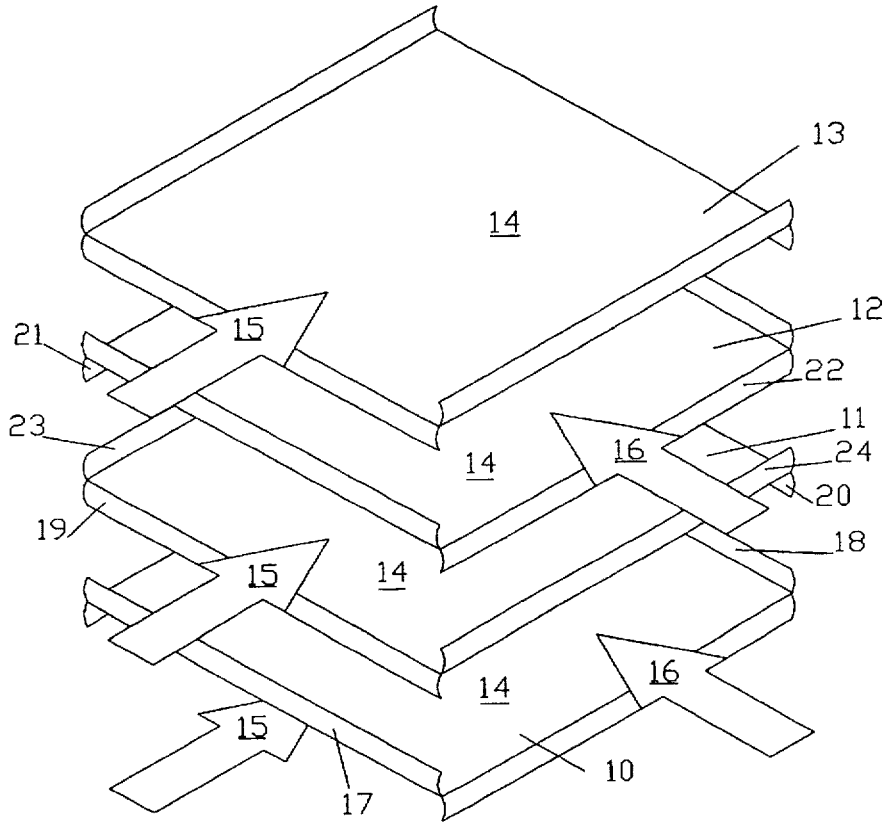
FIG. 1 is a schematic diagram showing the general concept of the present invention.

The core of the air-to-air heat exchanger is comprised of a plurality of flat, thin metal plates. The minimum number of plates that can make up a core is 3, however in actual practice many more plates are used. FIG. 1 shows only four plates 10, 11, 12 and 13. An operating core will have many more such plates. Each plate has a generally flat surface 14. The surface 14 can have ridges or circular indentations that increase the surface area of the surface 14 to increase the efficiency of the heat exchanger. For the purposes of explaining the present invention these surface contours have been removed from the plates shown in the drawings.

Air is forced over the surface 14 of the plates in two separated air paths 15 and 16. These two air paths are usually perpendicular to one another. A portion of the heat energy of the air flowing in the air path having the higher temperature is transferred to the air flowing in the air path having the lower temperature. This heat energy is transferred from one air path to the other air path via the surfaces 14.

FIG. 1 shows the plates separated in an unassembled form. When the core is assembled the flanges 19 and 20 of plate 11 are interference fit inside the flanges 17 and 18 of plate 10. Similarly, flanges 21 and 22 of plate 12 are fit inside the flanges 23 and 24 of plate 11. In this manner the entire core is assembled. Since the plates are square, and since the dimensions of each plate is the same, there is no reason why the flanges 17 and 18 of plate 10 could not be interference fit inside the flanges 19 and 20 of plate 11. If this were the case, the core would merely be assembled toward the bottom of FIG. 1.

Figure 2B:
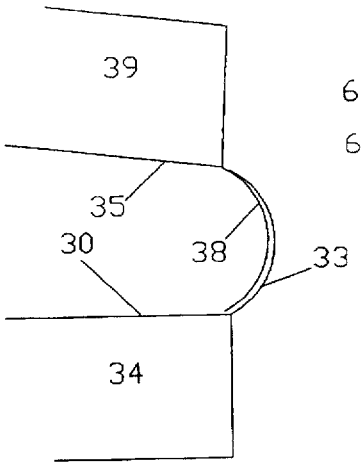
FIG. 2B is a detailed drawing of one end of a joined assembly of two plates.
Figure 2C:
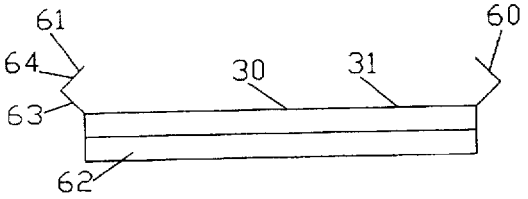
FIG. 2C is a drawing of an alternate embodiment of the flange for the plates shown in FIG. 2A.
Figure 2A:
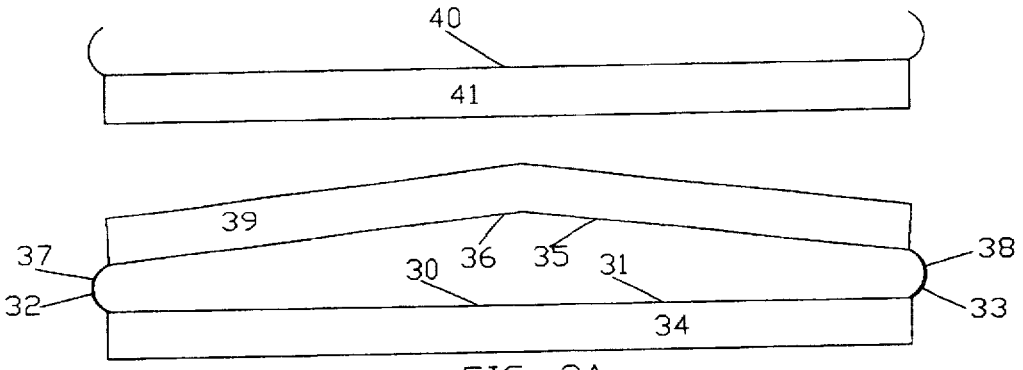
FIG. 2A is a drawing showing the assembly of two adjacent plates according to the present invention.

FIGS. 2A and 2B show the assembly of two adjacent plates in detail. Plate 30 has a flat generally square region 31 and four edge flanges 32, 33 and 34, with one flange not being visible in the figure. Flanges 32 and 33 are located on opposite sides of the square region 31 and are bent upwardly. Flanges 32 and 33 are curved inwardly. Plate 35 has a flat generally square region 36 and four edge flanges 37, 38 and 39 with one flange not being visible in the figure. Flanges 37 and 38 are located on opposite sides of the square region 36 and are bent downwardly. Flanges 37 and 38 are also curved inwardly. Because the two plates 30 and 35 have virtually the same dimensions, when flanges 37 and 38 of plate 35, are pushed inside flanges 32 and 33 of plate 30, they press outwardly on flanges 32 and 33 and buckle the surface 36 upwardly in the middle. When plate 40 is assembled with plates 30 and 35, flange 41 of plate 40 will contact flange 39 of plate 35. Flange 41 is placed inside flange 35 and the mating two flanges, not seen in the figure are similarly engaged. This causes plate 35 to flatten out since the mating flanges of plate 40 push the mating flanges of plate 35 outwardly. Plate 40 is then buckled in the region of the middle of the plate.

FIG. 2C is a diagram of an alternate embodiment of the plate. Instead of having inwardly curved edge flanges, the alternate embodiment has triangular shaped flanges. In FIG. 2C there is shown a plate 30 having a square central region 31. The plate has two pairs of opposed triangular flanges 60, 61 and 62 with the last triangular flange not being seen in the figure. Each triangular flange has a first part 63 bent at an angle less than 90 degrees outwardly from the central region 31 and a second distal part 64 that is bent so as to slope inwardly. When assembled the inner surface of the triangular shaped flanges of one plate make interference contact with the outer surface of the triangular shaped flanges of an adjacent plate.

This assembly process is carried on until the core is assembled with the correct number of plates to provide the correct air flow for the heat exchanger. Only the last top plate that is fitted so that its flanges are inside the mating flanges of the plate below will buckle. This last buckling situation is overcome by a frame structure into which the core is inserted which will be discussed below with reference to FIG. 3.

The straightening of each respective plate forces the outer arranged flanges of one plate to be urged outwardly and the inner arranged flanges of the adjacent plate to be urged inwardly. However, the material of each plate has a certain amount of resiliency and as a result a holding or sealing force will be exerted between interfering flanges. This force insures an airtight passage thereby isolating the two air paths discussed above.

FIG. 2B shows the detail of the left end of the assembly shown in FIG. 2A. In FIGS. 2A and 2B like elements have been given like reference numerals. It can be seen that flange 38 of plate 35 is located inside flange 33 of plate 30. When plate 35 is straightened by the addition of plate 40 to the assembly, flange 38 will push flange 33 outwardly and an interference will be established between the two flanges. The curved nature of the flanges insures that they do not easily pull apart during assembly, however the invention in general is not limited to the curved configuration and the side flanges could be bent into a triangular configuration as was described above.

Figure 3:
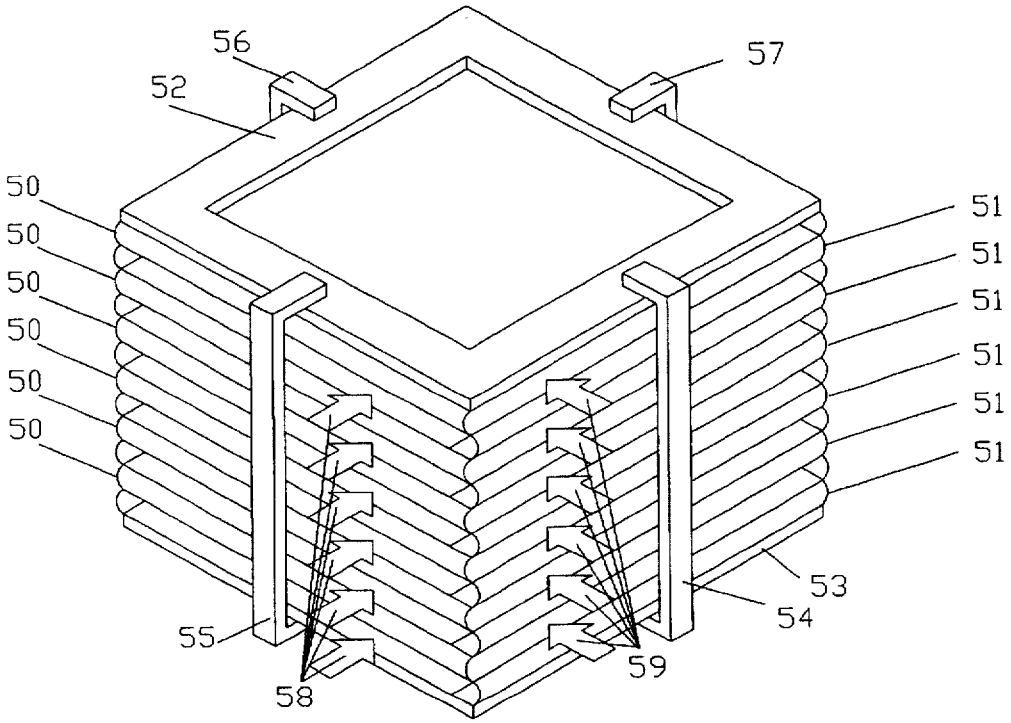
FIG. 3 is a schematic diagram of an assembled core according to the present invention.

A completely assembled core for an air-to-air heat exchanger according to the present invention is shown in FIG. 3. A plurality of plates 50, oriented in one direction are fitted so that their oppositely positioned flanges fit inside mating flanges of a plurality of adjacent plates 51. In order to secure the entire assembly and to remove the buckle of the very top plate 50 of the core, a frame assembly is provided. The frame assembly is comprised of top and bottom frame members 52 and 53. These two frame members are secured to the core by retaining members 54, 55, 56 and 57. It should be noted that FIG. 3 is merely a schematic diagram to show a completed core. In the actual assembled version of the core the retaining members would not be located in the mid positions of each face of the plates but most likely along the corners of the plates. However, that location would obscure the interrelationship of the various plates. FIG. 3 has therefore been altered for the sake of showing the invention in its simplest form and is merely provided in this form to best explain the nature of the invention.

The assembled core provides two air paths shown by arrows 58 and 59.

The plates can be made of any convenient metallic material. One example is aluminum. One typical core is comprised of 124 square plates each being 26.5 cms on a side. The flanges are 0.254 cms in depth and the thickness of the plate material is 0.14 mm.

I claim:

1. A core assembly for use in an air-to-air heat exchanger, said core comprising:

a plurality of square plates, each plate comprising:

an identical square planar central region;

a first pair of flexible opposed flanges bent in a first direction with respect to said central region to form approximately a 90 degree angle with the central region;

a second pair of flexible opposed edge flanges bent in a direction opposite said first direction with respect to said central region to form approximately a 90 degree angle with the central region;

wherein said core is formed by said plurality of square plates that are positioned into a stack of parallel plates such that the opposed flanges of one of said plurality of plates is located in contact with and inside mating opposed flanges of a plate directly adjacent thereto such that the opposed flanges of said one of said plurality of plates flexes inwardly and the mating opposed flanges of the plate directly adjacent flexes outwardly so that a seal is formed between the opposed flanges of the one plate and the mating opposed flanges of the plate directly adjacent thereto, thereby forming a plurality of air passages between adjacent plates such that two perpendicular air pathways are formed in an interleaved orientation;

frame means in contact with a bottom plate in said stack and a top plate in said stack for holding said plurality of plates in position.

2. The core assembly of claim 1, wherein laid opposed flanges are curved inwardly along their longitudinal length.

3. The core assembly of claim 1, wherein said opposed flanges are triangular shaped along their longitudinal length, such that the flange has a first region that slope outwardly from the central region and a second distal region that slopes inwardly.

4. The core assembly of claim 2, wherein the material of the plurality of plates is aluminum.

5. The core assembly of claim 4, wherein there are 124 plates.

6. The core assembly of claim 2, wherein the frame means comprises: a bottom support member in contact with said bottom plate; a top support member in contact with said top plate; and four side members joining said bottom support member with said top support member.

* * * * *